US006745402B2

(12) United States Patent
Caswell

(10) Patent No.: US 6,745,402 B2
(45) Date of Patent: Jun. 8, 2004

(54) PRECURVED GUSSETED GLOVE

(75) Inventor: Charles Caswell, Tulsa, OK (US)

(73) Assignee: OK-1 Manufacturing Company, Inc., Altus, OK (US)

( * ) Notice: Subject to any disclaimer, the term of this patent is extended or adjusted under 35 U.S.C. 154(b) by 0 days.

(21) Appl. No.: 09/727,853

(22) Filed: Dec. 1, 2000

(65) Prior Publication Data

US 2003/0167553 A1 Sep. 11, 2003

(Under 37 CFR 1.47)

Related U.S. Application Data

(60) Provisional application No. 60/168,249, filed on Dec. 1, 1999.

(51) Int. Cl.[7] ..... A41D 19/00
(52) U.S. Cl. ..... 2/161.1
(58) Field of Search ..... 2/16, 20, 163, 2/160, 161.1, 161.2, 161.3, 161.6, 166, 169; 482/44, 49

(56) References Cited

U.S. PATENT DOCUMENTS

| | | | | | |
|---|---|---|---|---|---|
| 2,314,545 | A | | 3/1943 | Lindfelt | D2/621 |
| D236,044 | S | | 7/1975 | Carter et al. | D29/113 |
| 4,051,552 | A | * | 10/1977 | Widdemer | 2/161.5 |
| 4,561,122 | A | | 12/1985 | Stanley et al. | |
| 4,590,627 | A | * | 5/1986 | Connelly | 2/163 |
| 4,747,163 | A | | 5/1988 | Dzierson | |
| 4,850,341 | A | | 7/1989 | Fabry et al. | |
| D335,368 | S | | 5/1993 | Houston | D29/113 |
| 5,214,799 | A | | 6/1993 | Fabry et al. | |
| D372,578 | S | | 8/1996 | Chapman | D2/610 |
| 5,603,118 | A | | 2/1997 | Solomon | |
| 5,632,045 | A | | 5/1997 | Chase et al. | |
| D382,087 | S | | 8/1997 | Arshed | D2/617 |
| 5,790,980 | A | | 8/1998 | Yewer, Jr. | |
| 5,896,584 | A | | 4/1999 | Hauser | |
| 5,911,313 | A | * | 6/1999 | Gold | 2/158 |
| 5,924,137 | A | * | 7/1999 | Gold | 2/159 |
| 6,012,170 | A | * | 1/2000 | Kim | 2/158 |
| 6,041,438 | A | | 3/2000 | Kirkwood | |
| 6,049,910 | A | * | 4/2000 | McCarter | 2/161.1 |
| 6,098,200 | A | | 8/2000 | Minkow et al. | |
| 6,199,211 | B1 | | 3/2001 | Franzolino | |
| 6,289,517 | B1 | | 9/2001 | Minkow et al. | |

* cited by examiner

*Primary Examiner*—Katherine Moran
(74) *Attorney, Agent, or Firm*—Crowe & Dunlevy, P.C.

(57) ABSTRACT

The present invention comprises a precurved gusseted glove which provides a user's hand(s) with an outer layer of protection which does not bunch together in the palm of the user. In one embodiment, the precurved gusseted glove is useful in weight training. The precurved gusseted glove has a gusseted side panel which precurves the glove to more naturally fit the curve of a human hand and eliminates the gathering of excess material in the palm of the hand.

4 Claims, 3 Drawing Sheets

PRECURVED GUSSETED GLOVE

CROSS-REFERENCE TO RELATED APPLICATIONS

This application claims the benefit of U.S. Provisional Patent Application Serial No. 60/168,249 filed Dec. 1, 1999 and entitled "Precurved Gusseted Glove".

STATEMENT REGARDING FEDERALLY SPONSORED RESEARCH OR DEVELOPMENT

NOT APPLICABLE

BACKGROUND OF THE INVENTION

1. Field of the Invention

The present invention comprises a precurved gusseted glove which provides a user's hand(s) with an outer layer of protection which does not bunch together in the palm of the user. In one embodiment, the precurved gusseted glove is useful in weight training. The precurved gusseted glove has a gusseted side panel which precurves the glove to more naturally fit the curve of a human hand and eliminates the gathering of excess material in the palm of the hand.

2. Brief Description of the Related Art

Many types of gloves have been designed for a wide variety of sports and activities. For example, a safety glove for football players is disclosed in U.S. Pat. No. 3,890,649; a basketball training glove is disclosed in U.S. Pat. No. 3,581,312; and a water-skiing glove is disclosed in U.S. Pat. No. 4,400,831. As other examples, a bowling glove is disclosed in U.S. Pat. No. 3,031,680; a sports glove for racquetball is disclosed in U.S. Pat. No. 4,525,877; a golf glove is disclosed in U.S. Pat. No. 2,154,197; and a baseball glove is disclosed in U.S. Pat. No. 425,887.

With respect to weight-lifting, U.S. Pat. No. 4,843,651, issued to Gramsza et al., discloses a glove with an elastic wrist support strap. U.S. Pat. No. 4,905,321, issued to Walunga, discloses a glove with a detachable wrist support strap. Finally, U.S. Pat. No. 4,958,384, issued to McCrane, discloses a glove with an inelastic wrist support strap. The Gramsza, Walunga and McCrane straps are constructed to encircle the wrist of a wearer in a shirt cuff fashion. Accordingly, the Gramsza, Walunga and McCrane gloves fail to keep the wearer's wrist and hand in a natural curled position without requiring a bunching of the glove material in the palm portion of the user's hand. Such bunching of glove material acts to prevent the wearer from acquiring a close and tight grip with an object such as a weight lifting bar.

Thus, an object of the present invention is to provide a glove, adapted for use in weight lifting, whereby the wearer's hand and wrist are kept in a natural curled position and which does not result in a bunching of glove material in the palm portion of the glove.

Other objects, features and advantages of the present invention are apparent from the following detailed description when read in conjunction with the accompanying drawings and appended claims.

SUMMARY OF THE INVENTION

The present invention is a glove adapted to be disposed over an individual's hand and wrist to thereby support the hand and wrist in a natural curled position when gripping an object. In particular, the glove includes a glove assembly having a palm side, a back side and an opening for receiving a hand of an individual; and at least one means for maintaining the glove assembly in a natural curled position, wherein the at least one means for maintaining the glove assembly in a natural curled position is disposed between the palm side and the back side of the glove assembly.

There are several embodiments of the glove of the present invention including a glove as described hereinabove further having a plurality of finger stalls and a thumb stall. In another embodiment the plurality of finger stalls and the thumb stall are open ended. In yet still another embodiment, glove of the present invention has a gusset which keeps the glove in a natural curled position.

DETAILED DESCRIPTION OF THE INVENTION

Figure 1:
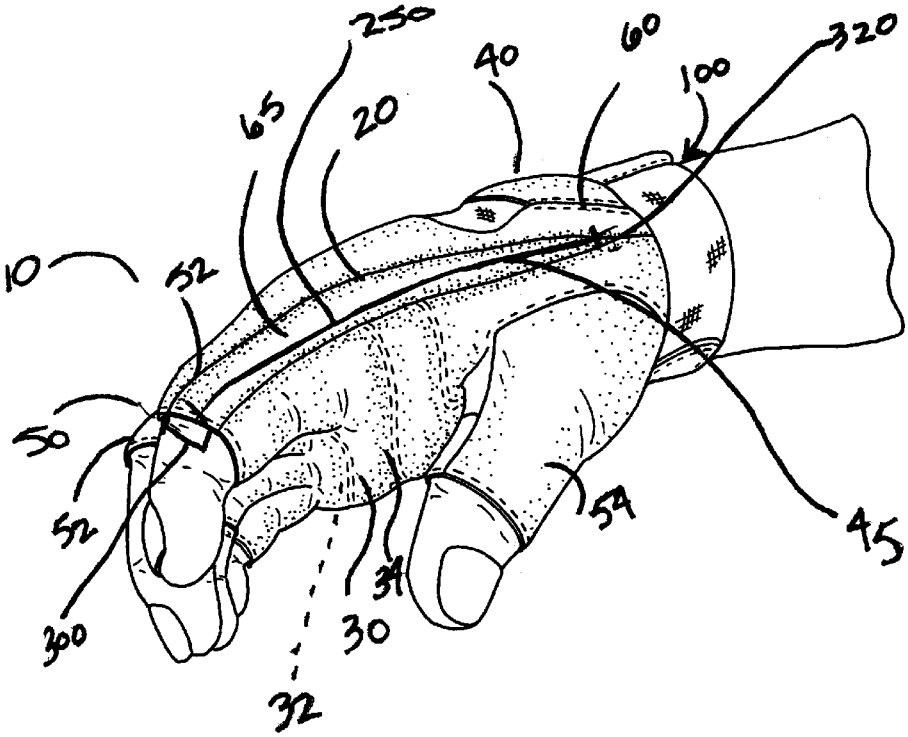
FIG. 1 is a perspective side view of the glove of the present invention on a user's right hand.

Before explaining in detail at least one embodiment of the invention in detail by way of exemplary drawings, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for purpose of description and should not be regarded as limiting.

It is desirous to adapt gloves to the anatomy of the hand. By way of example, a previous glove has been suggested wherein the back portion of the glove has one or more parts that are extended with respect to the corresponding parts of the palm portion of the glove to adapt the glove to the form of the hand in its rest position or else in a position having one or more fingers curved. While this prior art glove does provide a more natural curving form, it does not address the flexibility of the glove in relation to the user's hand and also does not overcome the amount of clasping force a user must exert in order to open and close the palm portion. Furthermore, this prior art glove results in a bunching of material in the palm portion when the glove is used, providing the user with an uncomfortable and loose grip.

Figure 2:
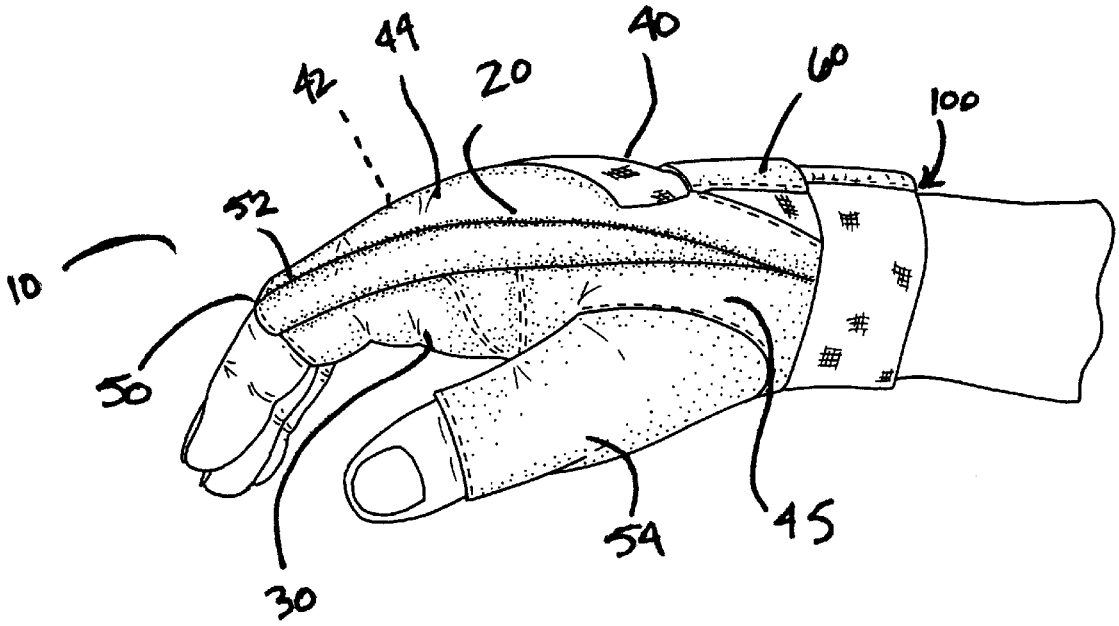
FIG. 2 is a plan side view of the glove of the present invention on a user's right hand.
Figure 3:
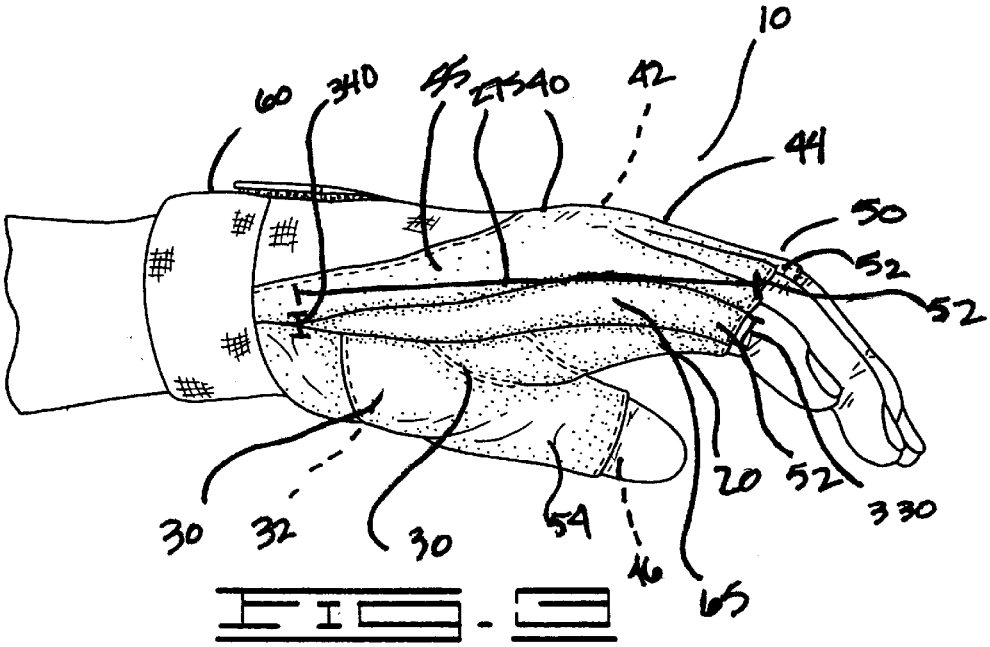
FIG. 3 is a plan side view of the little finger side of the glove of the present invention on a user's right hand.

Referring to the drawings in general, and to FIGS. 1, 2 and 3 in particular, shown therein and designated by the general reference numeral 10 is a precurved gusseted glove of the present invention, which includes a glove assembly 20 and an internal sleeve 100.

The glove assembly 20 includes a palm side 30, a back side 40, a thumb side 45, a finger end 50, a little finger side 55, a wrist end 60, and at least one means 65 for maintaining the glove assembly 20 in a natural curled position. The palm side 30 has an interior surface 32 and an exterior surface 34. The back side 40 has an interior surface 42 and an exterior surface 44. The finger end 50 includes four finger stalls 52 and a thumb stall 54. The little finger side 55 has an interior surface 56 and an exterior surface 57. The wrist end 60 has an interior surface 62 and an exterior surface 63.

The interior surface 32 of the palm side 30, the interior surface 42 of the back side 40, an interior surface 46 of the thumb side 45, the interior surface 56 of the little finger side 55, and the interior surface 62 of the wrist end 60 are operably connected to one another to thereby define an overall interior area 110 of the internal sleeve 100 of the glove assembly 20. A user's hand 70, which includes a wrist 75, a palm 80, knuckle area 85, and fingers 90, is placed within the overall interior area 110 of the internal sleeve 100 when in use.

The exterior surface 34 of the palm side 30, the exterior surface 44 of the back side 40, an exterior surface 47 of the thumb side 45, the exterior surface 57 of the little finger side 55, and the exterior surface 63 of the wrist end 60 are operably connected to one another to thereby define an overall exterior area 120 of the glove assembly 20. The overall exterior area 120 of the glove assembly 20 is the area that is apparent on the user's hand 70 as shown in FIGS. 1–5.

Figure 4:
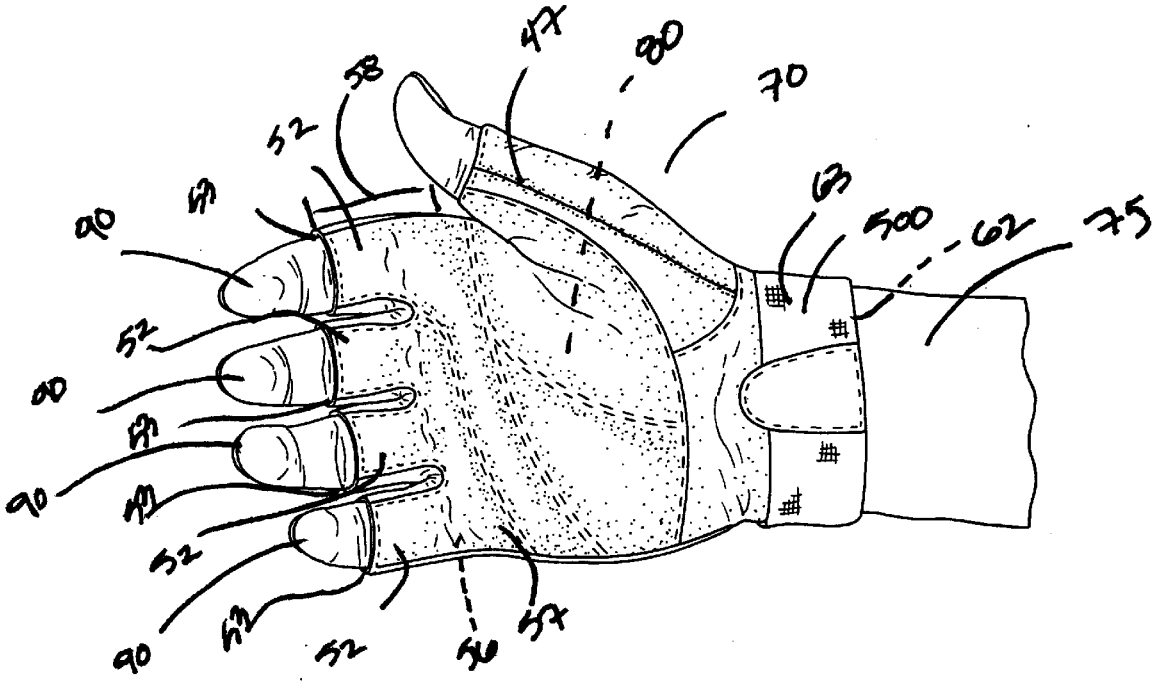
FIG. 4 is a plan bottom view of the glove of the present invention on a user's right hand.
Figure 5:
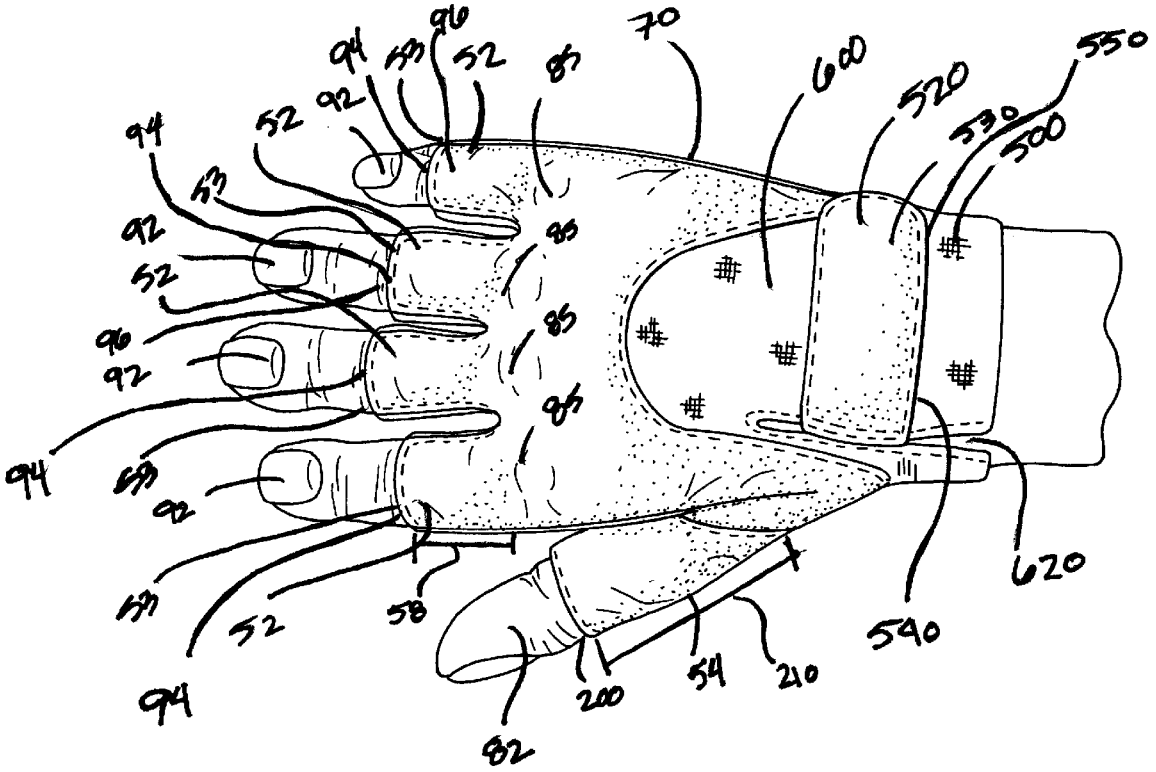
FIG. 5 is a plan top view of the glove of the present invention on a user's right hand.

In one embodiment, and as shown in FIGS. 4 and 5, each one of the four finger stalls 52 of the finger end 50 have an open end 53 and a length 58 such that each finger 90 of the user's hand 70 is bare from a finger tip area 92 to a point 94 between the knuckle area 85 and a first finger joint 96 of the finger 90. However, the glove assembly 20 may be constructed such that some or all of the four finger stalls 52 have any length 58, from no length at all to full-finger length. Full length four finger stalls 52 may be close-ended rather than open-ended.

In similar fashion, the thumb stall 54 typically has an open end 200 and a length 210 such that a thumb 82 of the user's hand 70 protrudes from the thumb stall 54. However, the glove assembly 20 may be constructed such that the thumb stall 54 has any length 210, from no length at all to full-thumb length. Full length thumb stall 54 may be close-ended rather than open-ended.

The palm side 30 of the glove assembly 20 may be padded substantially as shown in FIG. 1, or in any other suitable manner so long as the padding does not interfere with the natural curled position of the precurved gusseted glove 10. Typically, the glove assembly 20 is padded with foam rubber or the like stitched into the palm side 30 of the glove assembly 20.

The means 65 for maintaining the glove assembly 20 in a natural curled position is located on at least one of the thumb side 45 and/or the little finger side 55 of the glove assembly 20. As shown in FIG. 1, the means 65 for maintaining the glove assembly 20 in a natural curled position is shown as being located between the palm side 30 and the back side 40 of the glove assembly 20 and extends along a first length 250 from the finger end 50 to the wrist end 60 of the glove assembly 20. As shown in FIGS. 1 and 2, the means 65 for maintaining the glove assembly 20 in a natural curled position tapers from a first width 300 to a second width 320 along the first length 250. In particular, the first width 300 is larger than the second width 320 such that the means 65 for maintaining the glove assembly 20 in a natural curled position is effectively a gusset—thereby allowing the user's hand 70 while wearing the glove assembly 20 to grip an object without a buildup of material or padding in the palm side 30 of the glove assembly 20.

Similarly, as shown in FIG. 3, the means 65 for maintaining the glove assembly 20 in a natural curled position is located as being on the little finger side 55 of the glove assembly 20. Thus, it can be appreciated that the means 65 for maintaining the glove assembly 20 in a natural curled position may be located solely on the thumb side 45 or the little finger side 55 or the means 65 for maintaining the glove assembly 20 in a natural curled position may be located on both the thumb side 45 and the little finger side 55. As shown in FIG. 3, the means 65 for maintaining the glove assembly 20 in a natural curled position is located on the little finger side 55 between the palm side 30 and the back side 40 of the glove assembly 20. When on the little finger side 55 of the glove assembly 20, the means 65 for maintaining the glove assembly 20 tapers from a third width 330 to a fourth width 340 along a second length 275 from the finger end 50 to the wrist end 60 of the glove assembly 20. In particular, the third width 330 is larger than the fourth width 340 such that the means 65 for maintaining the glove assembly 20 in a natural curled position is effectively a gusset—thereby allowing the user's hand 70 while wearing the glove assembly 20 to grip an object without a buildup of material or padding in the palm side 30 of the glove assembly 20.

As shown in FIGS. 4 and 5, the wrist end 60 of the glove assembly 20 further includes a wrist cuff 500 and a securing strap 520. The securing strap 520 has a bottom side 530 and a top side 540. On the bottom side 530 of the securing strap 520 is a strip of material (not shown) that coordinates with a securing portion 550 of the wrist cuff 500. This strip of material and the securing portion 550 of the wrist cuff 500 are typically made of complementary strips of hook and loop fasteners, such as Velcro® or the like.

On the back side 40 of the glove assembly 20, the glove assembly 20 may have a flexible fabric panel 600. At the wrist cuff 500 of the glove assembly 20, the flexible fabric panel 600 may have a slit 620 which allows for the user's hand 70 to be more comfortably placed within the glove assembly 20. Also, slit 620 will also allow the securing strap 520 to be tightened and secured to the wrist cuff 500 via the strip of material (not shown) on the bottom side 530 of the securing strap 520 and the securing portion 550 of the wrist cuff 500, such that the wrist cuff 500 is securely positioned around the wrist 75 of the user's hand 70.

Typically, the glove assembly 20 is constructed of leather or the like. However, the glove assembly 20 may be made of any material which has properties consistent with the purpose of the present invention.

The use of the precurved gusseted glove 10 is not limited to weight lifting. The precurved gusseted glove 10 may be used in any sort of activity where the user's hand is preferentially kept in a natural curled position when gripping an object and where it is desirous that the material of the chosen glove not bunch in the palm of the user when gripping the object. The precurved gusseted glove 10 is described hereinabove and illustrated in the drawings as a right-handed glove. However, it should be appreciated that the present invention contemplates and includes a left-handed precurved gusseted glove constructed in a manner consistent with the disclosure made herein.

Thus, in accordance with the present invention, there has been provided a precurved gusseted glove that fully satisfies the objectives and advantages set forth above. Although the invention has been described in conjunction with the specific drawings and language set forth above, it is evident that many alternatives, modifications and variations will be apparent to those skilled in the art. Accordingly, it is intended to embrace all such alternatives, modifications and variations that fall within the spirit and broad scope of the invention.

What I claim is:

1. A glove adapted to be disposed over an individual's hand and wrist for supporting the hand and wrist in a natural curled position when gripping an object, comprising:

a glove assembly having a palm side, a back side and an opening for receiving a hand of an individual; and at least one means for maintaining the glove assembly in a natural curled position, wherein the at least one means for maintaining the glove assembly in a natural curled position is disposed between the palm side and the back side of the glove assembly.

2. The glove of claim 1, further comprising a plurality of finger stalls and a thumb stall.

3. The glove of claim 2, wherein the plurality of finger stalls and the thumb stall are open ended.

4. The glove of claim 1, wherein the at least one means for maintaining the glove assembly in a natural curled position is a gusset.

* * * * *